US010538097B2

(12) United States Patent
Murakami et al.

(10) Patent No.: US 10,538,097 B2
(45) Date of Patent: Jan. 21, 2020

(54) EJECTION DEVICE AND IMAGE FORMING APPARATUS

(71) Applicant: FUJI XEROX CO., LTD., Tokyo (JP)

(72) Inventors: Atsushi Murakami, Ebina (JP); Masashi Hiratsuka, Ebina (JP); Masaki Kataoka, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 16/032,149

(22) Filed: Jul. 11, 2018

(65) Prior Publication Data

US 2019/0248147 A1 Aug. 15, 2019

(30) Foreign Application Priority Data

Feb. 15, 2018 (JP) ..... 2018-025294

(51) Int. Cl.
*B41J 2/175* (2006.01)
*B41J 2/045* (2006.01)
*B41J 2/14* (2006.01)

(52) U.S. Cl.
CPC ..... *B41J 2/17596* (2013.01); *B41J 2/04501* (2013.01); *B41J 2/14233* (2013.01)

(58) Field of Classification Search
CPC . B41J 2/17596; B41J 2/04501; B41J 2/14233
USPC ..... 347/84, 85, 94
See application file for complete search history.

(56) References Cited

U.S. PATENT DOCUMENTS 8,162,453 B2 * 4/2012 Kojima ..... B41J 2/17596 347/6
8,240,823 B2 * 8/2012 Murakami ..... B41J 2/18 347/17
8,579,422 B2 * 11/2013 Matsuoka ..... B41J 2/175 347/85
2008/0192095 A1 8/2008 Kojima
2013/0215179 A1 8/2013 Ishikura

FOREIGN PATENT DOCUMENTS

JP 2008-221838 9/2008
JP 5462951 1/2014

* cited by examiner

*Primary Examiner* — An H Do
(74) *Attorney, Agent, or Firm* — Fildes & Outland, P.C.

(57) ABSTRACT

An ejection device includes: ejection portions that eject liquids; supply portions that supply the liquids to the ejection portions respectively; a common pressure applying mechanism that applies pressure onto the liquids at the supply portions; and a pressure difference generating mechanism that generates a relative pressure difference between the ejection portions for the liquids to be supplied from the supply portions to the ejection portions.

14 Claims, 14 Drawing Sheets

EJECTION DEVICE AND IMAGE FORMING APPARATUS

CROSS-REFERENCE TO RELATED APPLICATIONS

This application is based on and claims priority under 35 USC 119 from Japanese Patent Application No. 2018-025294 filed on Feb. 15, 2018.

BACKGROUND

1. Technical Field

The present invention relates to an ejection device and an image forming apparatus.

2. Related Art

A configuration in which a pressure reducing pump connected to a buffer tank and differential pressure valves provided in sub tanks respectively are used in combination to control back pressures of respective printing heads has been disclosed in JP-A-2008-221838.

SUMMARY

In a configuration in which pressure applying mechanisms apply pressures onto liquids (e.g. inks) of supply portions (e.g. supply tanks) respectively to thereby generate back pressures varying between ejection portions (e.g. ejecting heads), the pressure applying mechanisms as many as the supply portions are required.

Aspects of non-limiting embodiments of the present disclosure make it possible to generate back pressures varying between ejection portions while reducing the number of pressure applying mechanisms, in comparison with a configuration in which pressure applying mechanisms apply pressures onto liquids of supply portions respectively to thereby generate a relative pressure difference between the ejection portions for the liquids.

Aspects of certain non-limiting embodiments of the present disclosure overcome the above disadvantages and other disadvantages not described above. However, aspects of the non-limiting embodiments are not required to overcome the disadvantages described above, and aspects of the non-limiting embodiments of the present disclosure may not overcome any of the problems described above.

According to an aspect of the invention, there is provided an ejection device comprising: ejection portions that eject liquids; supply portions that supply the liquids to the ejection portions respectively; a common pressure applying mechanism that applies pressure onto the liquids at the supply portions; and a pressure difference generating mechanism that generates a relative pressure difference between the ejection portions for the liquids to be supplied from the supply portions to the ejection portions.

BRIEF DESCRIPTION OF THE DRAWINGS

Exemplary embodiments of the present invention will be described in detail based on the following figures, wherein.

REFERENCE SIGNS LIST

10, 200 inkjet recording apparatus (example of image forming apparatus)
12 ejection mechanism (example of ejection device)
20 feed mechanism (example of feed portion)
32Y, 32M ejection head
44, 45 supply tank (example of supply portion)
46, 47 supply channel (example of supply route)
50 pressure applying mechanism (example of first pressure applying mechanism, example of pressure generating mechanism)
60 pressure difference generating mechanism (example of first pressure difference generating mechanism, example of change mechanism)
74, 75 collection tank (example of collection portion)
80 pressure applying mechanism (example of second pressure applying mechanism)
90 pressure difference generating mechanism (example of second pressure difference generating mechanism)
120 resistance applying mechanism
126 resistor

320 resistance applying mechanism
326 resistor

DETAILED DESCRIPTION

Exemplary embodiments according to the present invention will be described below based on the drawings.

First Exemplary Embodiment

Inkjet Recording Apparatus 10

Figure 1:
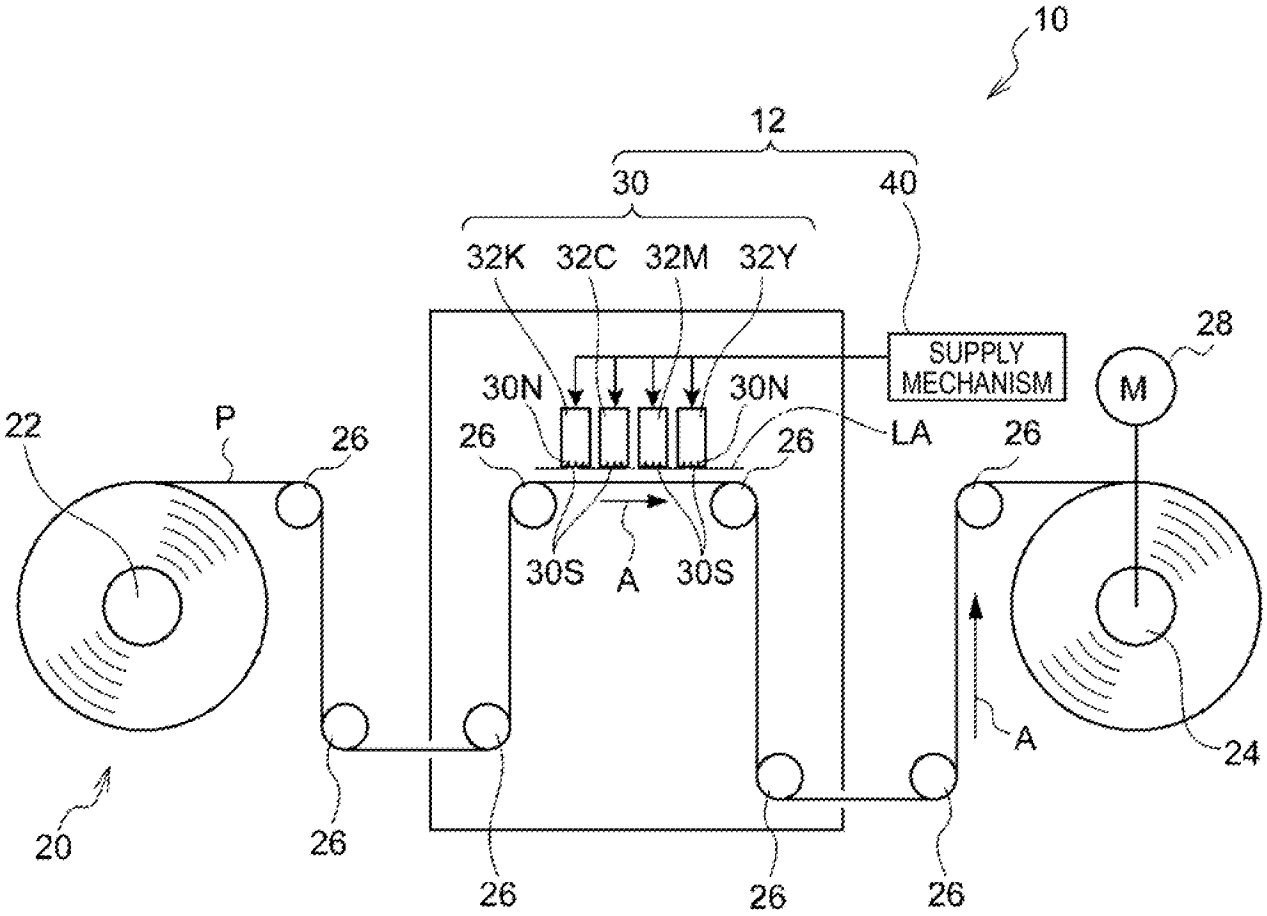
FIG. 1 is a schematic view showing a configuration of an inkjet recording apparatus according to a first exemplary embodiment.

An inkjet recording apparatus 10 according to a first exemplary embodiment will be described. FIG. 1 is a schematic view showing the configuration of the inkjet recording apparatus 10.

The inkjet recording apparatus 10 is an example of an image forming apparatus that forms an image on a recording medium. Specifically, the inkjet recording apparatus 10 is an apparatus that ejects inks onto the recording medium to thereby form an image on the recording medium. More specifically, the inkjet recording apparatus 10 is an apparatus that ejects ink droplets onto continuous paper P (an example of the recording medium) to thereby form an image on the continuous paper P, as shown in FIG. 1. The continuous paper P is along recording medium that has a length in a feeding direction in which the continuous paper P is fed.

The inkjet recording apparatus 10 is provided with a feed mechanism 20 and an ejection mechanism 12, as shown in FIG. 1. Specific configurations of respective portions (the feed mechanism 20 and the ejection mechanism 12) of the inkjet recording apparatus 10 will be described below.

Feed Mechanism 20

The feed mechanism 20 is an example of a feed portion that feeds the recording medium. Specifically, the feed mechanism 20 is a mechanism that feeds the continuous paper P. More specifically, the feed mechanism 20 has an unwind roll 22, a wind-up roll 24 and wind rolls 26, as shown in FIG. 1.

The unwind roll 22 is a roll that unwinds the continuous paper P. The continuous paper P is wound around the unwind roll 22 in advance. When the unwind roll 22 rotates, the continuous paper P wound around the unwind roll 22 is unwound.

The wind rolls 26 are rolls on which the continuous paper P can be wound. Specifically, the continuous paper P can be wound on the wind rolls 26 between the unwind roll 22 and the wind-up roll 24. Thus, a feeding path of the continuous paper P from the unwind roll 22 to the wind-up roll 24 is determined.

The wind-up roll 24 is a roll that winds up the continuous paper P. The wind-up roll 24 is driven and rotated by a driving portion 28. Thus, the wind-up roll 24 winds up the continuous paper P and the unwind roll 22 unwinds the continuous paper P. When the continuous paper P is wound up by the wind-up roll 24 and unwound by the unwind roll 22, the continuous paper P is fed. The wind rolls 26 are driven by the fed continuous paper P to rotate. Incidentally, in the respective drawings, the feeding direction of the continuous paper P (that may be hereinafter referred to as "feeding direction" simply) is indicated by an arrow A suitably.

Ejection Mechanism 12

The ejection mechanism 12 is an example of an ejection device that ejects inks as liquids from ejection portions onto the recording medium fed by the feed portion. Specifically, the ejection mechanism 12 is a mechanism that ejects ink droplets from undermentioned ejection heads 32Y to 32K onto the continuous paper P fed by the feed mechanism 20. More specifically, the ejection mechanism 12 is provided with an ejection unit 30 and a supply mechanism 40. Specific configurations of respective portions (the ejection unit 30 and the supply mechanism 40) of the ejection mechanism 12 will be described below.

Ejection Unit 30

The ejection unit 30 is a unit that ejects ink droplets (an example of droplets). Specifically, the ejection unit 30 has the ejection heads 32Y, 32M, 32C and 32K (hereinafter referred to as 32Y to 32K), as shown in FIG. 1.

Each of the ejection heads 32Y to 32K is an example of the ejection portion that ejects a liquid. Specifically, the ejection head 32Y to 32K is a head ejecting ink droplets (an example of the droplets) from nozzles 30N onto the continuous paper P. More specifically, the ejection head 32Y to 32K is a head ejecting ink droplets of a corresponding color of yellow (Y), magenta (M), cyan (C) and black (K) to the continuous paper P.

As shown in FIG. 1, the ejection heads 32Y to 32K are disposed sequentially in a direction toward an upstream side of the feeding direction of the continuous paper P. Each of the ejection heads 32Y to 32K has a length in a widthwise direction of the continuous paper P (crossing direction crossing the feeding direction of the continuous paper P).

The ejection head 32Y to 32K has a nozzle surface 30S where the nozzles 30N are formed. The nozzle surface 30S of the ejection head 32Y to 32K faces down to be opposed to the continuous paper P fed by the feed mechanism 20. By a known system such as a thermal system or a piezoelectric system, the ejection head 32Y to 32K ejects ink droplets from the nozzles 30N onto the continuous paper P to thereby form an image on the continuous paper P.

The ejection heads 32Y to 32K are disposed so that the nozzle surfaces 30S of the ejection heads 32Y to 32K are positioned at vertically the same position (the same height). In other words, the ejection heads 32Y to 32K are disposed in such a manner that, of the ejection heads 32Y to 32K, the nozzle surfaces of the other ejections heads extend on an extension line LA in line with the nozzle surface of one ejection head.

For example, water-based ink and oil-based ink can be used as the ink used in each of the ejection heads 32Y to 32K. The water-based ink contains, for example, a solvent containing water as a main component, a coloring agent (pigment or dye), and another additive agent. The oil-based ink contains, for example, an organic solvent, a coloring agent (pigment or dye) and another additive agent.

Supply Mechanism 40

Figure 2:
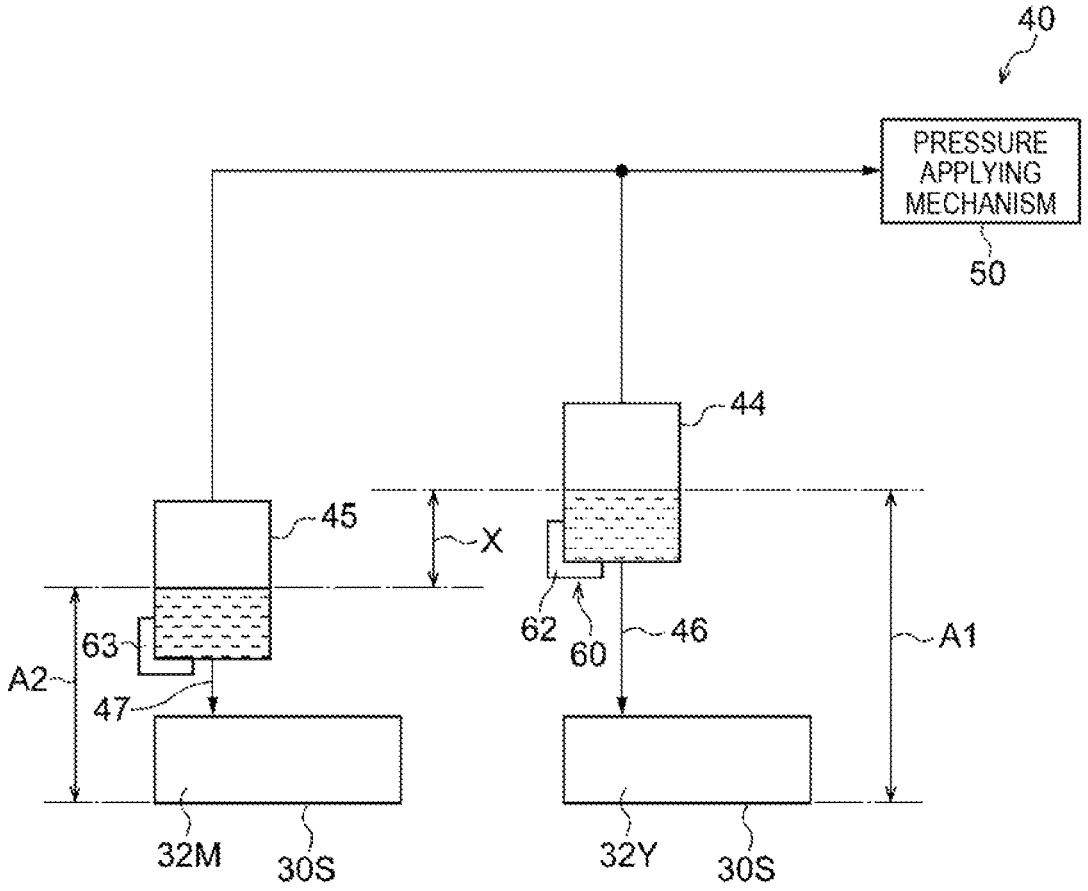
FIG. 2 is a schematic view showing a configuration about ejection heads and a supply mechanism according to the first exemplary embodiment.

The supply mechanism 40 is a mechanism that supplies ink to each of the ejection heads 32Y to 32K. Incidentally, constituent portions of the supply mechanism 40 that supply the inks to the ejection heads 32Y and 32M will be described below. FIG. 2 is a schematic view schematically showing a configuration about the ejection heads 32Y and 32M and the supply mechanism 40.

The supply mechanism 40 has supply tanks 44 and 45, supply channels 46 and 47, a pressure applying mechanism 50 and a pressure difference generating mechanism 60.

The supply tanks 44 and 45 are an example of supply portions that supply liquids to the ejection portions respectively. Specifically, each of the supply tanks 44 and 45 has a function of supplying ink to a corresponding one of the ejection heads 32Y and 32M. More specifically, the supply tank 44, 45 functions as a reservoir portion that reserves the ink to be supplied to the ejection head 32Y, 32M.

Incidentally, when the ink in the supply tank 44, 45 is consumed, ink is replenished into the supply tank 44, 45 by a replenishment mechanism (not shown).

The supply channels 46 and 47 are an example of supply routes from the supply portions to the ejection portions respectively. Specifically, the supply channels 46 and 47 are routes (passageways) through which inks are supplied from the supply tanks 44 and 45 to the ejection heads 32Y and 32M respectively. More specifically, each of the supply channels 46 and 47 has one end portion (upstream end portion) connected to the supply tank 44, 45, and the other end portion (downstream end portion) connected to the ejection head 32Y, 32M.

The pressure applying mechanism 50 is an example of a common pressure applying mechanism that applies pressure onto the liquids at the supply portions. Specifically, the pressure applying mechanism 50 has a function of applying common pressure onto inks in the supply tanks 44 and 45. More specifically, a pressure transmission route from the pressure applying mechanism 50 is split and connected to the supply tanks 44 and 45. The pressure applying mechanism 50 applies the common pressure onto the inks in the supply tanks 44 and 45 through the transmission route. Specifically, the pressure mentioned herein is negative pressure. More specifically, the pressure applying mechanism 50 is constituted, for example, by a single vacuum pump.

The pressure difference generating mechanism 60 is an example of a pressure difference generating mechanism that generates a relative pressure difference between the ejection portions for the liquids to be supplied from the supply portions to the ejection portions. Specifically, the pressure difference generating mechanism 60 generates a relative pressure difference between the ejection heads 32Y and 32M for the inks to be supplied from the supply tanks 44 and 45 to the ejection heads 32Y and 32M.

More specifically, the pressure difference generating mechanism 60 is constituted by support bodies 62 and 63 that support the supply tanks 44 and 45 at different heights (i.e. vertically different positions) respectively. The support bodies 62 and 63 generate the relative pressure difference between the inks to be supplied from the supply tanks 44 and 45 to the ejection heads 32Y and 32M due to a hydraulic head difference X between the supply tanks 44 and 45 supported at the different heights. That is, the pressure difference generating mechanism 60 generates the relative pressure difference between the inks to be suppled from the supply tanks 44 and 45 to the ejection heads 32Y and 32M due to the hydraulic head difference X between a liquid surface of the supply tank 44 and a liquid surface of the supply tank 45.

In other words, the support bodies 62 and 63 support the supply tanks 44 and 45 so that a hydraulic head difference (see A1) between the liquid surface of the supply tank 44 and the nozzle surface 30S of the ejection head 32Y and a hydraulic head difference (see A2) between the liquid surface of the supply tank 45 and the nozzle surface 30S of the ejection head 32M vary from each other. Thus, the relative pressure difference is generated between the inks to be supplied from the supply tanks 44 and 45 to the ejection heads 32Y and 32M.

In the present exemplary embodiment, the supply tank 44 is disposed at a higher position than the supply tank 45. The liquid surface of the supply tank 44 is disposed at a higher position than the liquid surface of the supply tank 45. Thus, the hydraulic head difference A1 is larger than the hydraulic head difference A2.

Incidentally, in the present exemplary embodiment, both the supply tanks 44 and 45 are disposed at positions higher than the nozzle surfaces 30S of the ejection heads 32Y and 32M. That is, when only the pressure difference generating mechanism 60 is viewed, positive pressure is applied onto the ink to be supplied from each of the supply tanks 44 and 45 to each of the ejection heads 32Y and 32M. In addition, an absolute value of the positive pressure is smaller than an absolute value of the negative pressure commonly applied onto the inks in the supply tanks 44 and 45 by the pressure applying mechanism 50.

The pressure applying mechanism 50 is also an example of a common pressure generating mechanism that generates reference pressure as a reference for the liquids to be supplied from the supply portions to the ejection portions respectively. Specifically, the pressure applying mechanism 50 has a function of generating reference pressure as a reference for the inks to be supplied from the supply tanks 44 and 45 to the ejection heads 32Y and 32M respectively.

The pressure difference generating mechanism 60 is also an example of a change mechanism that changes the reference pressure generated for the liquid to be supplied from one of the supply portions to one of the ejection portions, to different pressure. Specifically, the pressure difference generating mechanism 60 has a function of changing the reference pressure generated for the ink to be supplied from the supply tank 45 to the ejection head 32M, to different pressure.

When, for example, pressure applied onto the ink to be supplied from the supply tank 44 to the ejection head 32Y is set as the reference pressure, pressure applied onto the ink to be supplied from the supply tank 45 to the ejection head 32M is changed due to the hydraulic head difference X between the supply tanks 44 and 45 generated by the pressure difference generating mechanism 60.

Effect of First Exemplary Embodiment

According to the supply mechanism 40 of the inkjet recording apparatus 10, the pressure applying mechanism 50 applies common pressure onto the inks in the supply tanks 44 and 45. Further, the support bodies 62 and 63 in the pressure difference generating mechanism 60 generate the relative pressure difference between the inks to be supplied from the supply tanks 44 and 45 to the ejection heads 32Y and 32M due to the hydraulic head difference X between the supply tanks 44 and 45 supported at the different heights.

Figure 3:
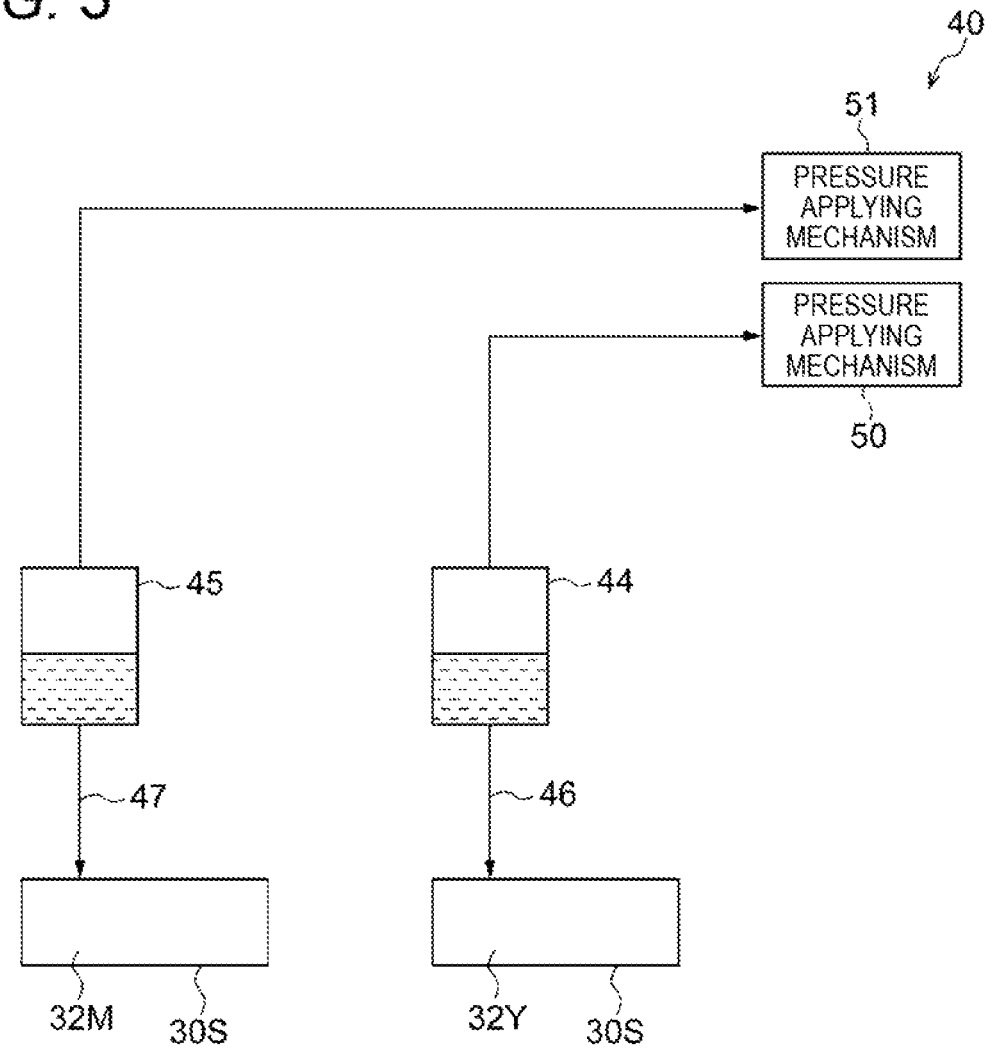
FIG. 3 is a schematic view showing a configuration about ejection heads and a supply mechanism according to a first comparative example.

Here, in a configuration (first comparative example) in which pressure applying mechanisms 50 and 51 apply pressures onto inks in supply tanks 44 and 45 respectively to generate a relative pressure difference between the inks in ejection heads 32Y and 32M, as shown in FIG. 3, the pressure applying mechanisms as many as the supply tanks are required. That is, a plurality of (specifically two) pressure applying mechanisms are required in the first comparative example.

On the other hand, in the present exemplary embodiment, the pressure applying mechanism 50 applies common pressure onto the inks in the supply tanks 44 and 45, and the pressure difference generating mechanism 60 generates a relative pressure difference between the inks to be supplied from the supply tanks 44 and 45 to the ejection heads 32Y and 32M, as described above. Therefore, back pressures varying between the ejection heads 32Y and 32M can be generated while the number of pressure applying mechanisms is reduced, in comparison with the first comparative example. Since the back pressures varying between the ejection heads 32Y and 32M are generated thus, the back pressures varying from each other can be set, for example, in accordance with ink characteristics of the ejection heads 32Y and 32M.

Figure 4:
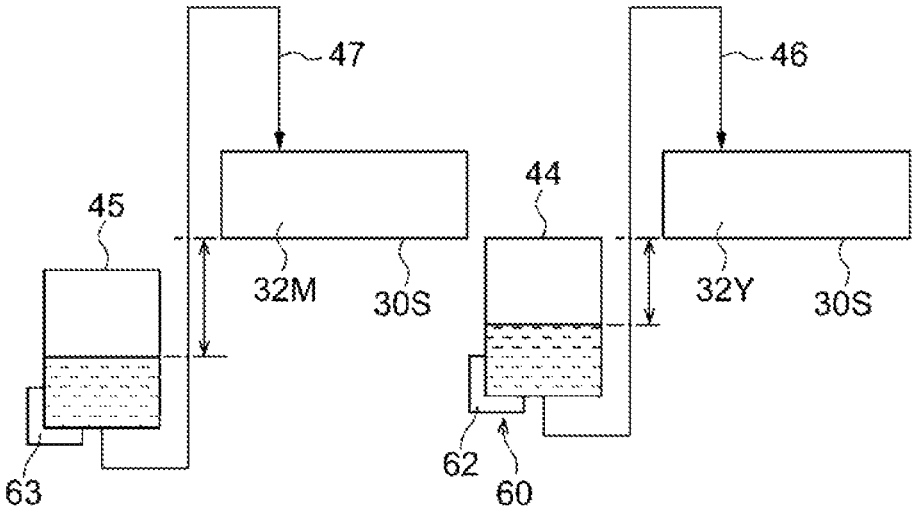
FIG. 4 is a schematic view showing a configuration about ejection heads and a supply mechanism according to a second comparative example.

In addition, in a configuration (second comparative example) in which back pressures are generated for inks in ejection heads 32Y and 32M due to only hydraulic head differences between liquid surfaces of supply tanks 44 and 45 and nozzle surfaces 30S of the ejection heads 32Y and 32M, as shown in FIG. 4, heights of the liquid surfaces of the supply tanks 44 and 45 have to be disposed to be lower than heights of the nozzle surfaces 30S of the ejection heads 32Y and 32M. Accordingly, there is a restriction on positions where the supply tanks 44 and 45 can be disposed in the second comparative example.

On the other hand, in the present exemplary embodiment, the pressure applying mechanism 50 applies the common pressure onto the inks in the supply tanks 44 and 45, and the pressure difference generating mechanism 60 generates the relative pressure difference between the inks to be supplied from the supply tanks 44 and 45 to the ejection heads 32Y and 32M, as described above. Therefore, heights of the liquid surfaces of the supply tanks 44 and 45 may be disposed to be higher than heights of the nozzle surfaces 30S of the ejection heads 32Y and 32M. Thus, the degree of freedom for positions where the supply tanks 44 and 45 can be disposed is higher than that in the second comparative example.

In addition, in the present exemplary embodiment, the pressure difference generating mechanism 60 generates the relative pressure difference between the inks to be supplied from the supply tanks 44 and 45 to the ejection heads 32Y and 32M due to the hydraulic head difference X between the supply tanks 44 and 45 supported at the different heights, as described above. Therefore, even when flow resistances applied onto the inks in the supply channels 46 and 47 are made equal to each other, a relative pressure difference can be generated between the inks to be supplied from the supply tanks 44 and 45 to the ejection heads 32Y and 32M.

First Modification of First Exemplary Embodiment

Figure 5:
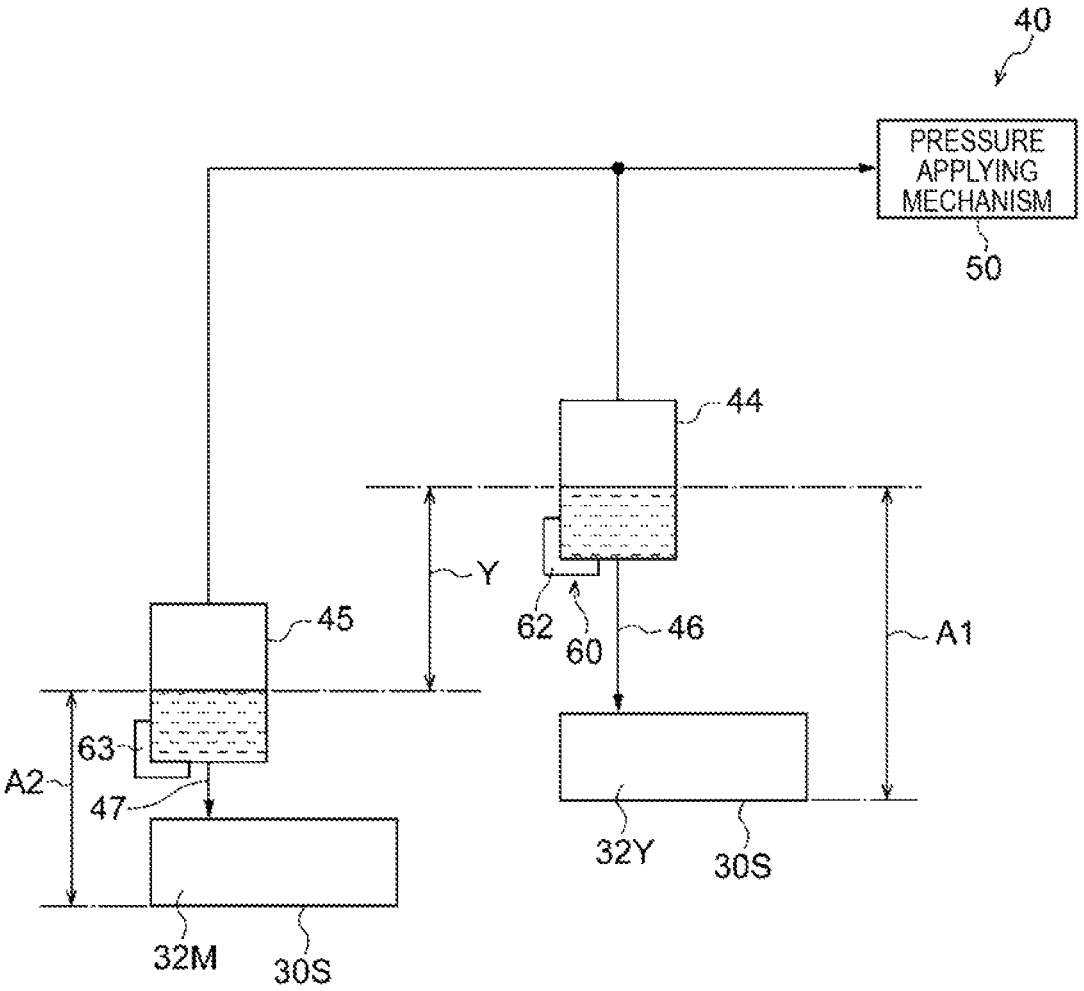
FIG. 5 is a schematic view showing a configuration about ejection heads and a supply mechanism according to a first modification of the first exemplary embodiment.

In the aforementioned exemplary embodiment, the ejection heads 32Y and 32M are disposed so that the nozzle surfaces 30S of the ejection heads 32Y and 32M are positioned at the same height. However, the present invention is not limited thereto. For example, as shown in FIG. 5, the ejection heads 32Y and 32M may be disposed so that the nozzle surfaces 30S of the ejection heads 32Y and 32M are positioned at vertically different positions (different heights). Specifically, for example, the ejection head 32Y is disposed at a higher position than the ejection head 32M.

Also in the configuration, the support bodies 62 and 63 generate a relative pressure difference between the inks to be supplied from the supply tanks 44 and 45 to the ejection heads 32Y and 32M due to a hydraulic head difference Y between the supply tanks 44 and 45 supported at different heights. That is, the relative pressure difference is generated between the inks to be supplied from the supply tanks 44 and 45 to the ejection heads 32Y and 32M due to the hydraulic head difference Y between a liquid surface of the supply tank 44 and a liquid surface of the supply tank 45.

In other words, the support bodies 62 and 63 support the supply tanks 44 and 45 so that a hydraulic head difference (see A1) between the liquid surface of the supply tank 44 and the nozzle surface 30S of the ejection head 32Y and a hydraulic head difference (see A2) between the liquid surface of the supply tank 45 and the nozzle surface 30S of the ejection head 32M vary from each other. Thus, the relative pressure difference is generated between the inks to be supplied from the supply tanks 44 and 45 to the ejection heads 32Y and 32M.

Incidentally, the hydraulic head difference Y between the liquid surface of the supply tank 44 and the liquid surface of the supply tank 45 is larger than the hydraulic head difference X (see FIG. 2) in the aforementioned first exemplary embodiment.

Also in the configuration of the present first modification, the pressure applying mechanism 30 applies common pressure onto the inks in the supply tanks 44 and 45, and the pressure difference generating mechanism 60 generates the relative pressure difference between the inks to be supplied from the supply tanks 44 and 45 to the ejection heads 32Y and 32M, as described above. Therefore, even when the vertically relative positions of the ejection heads 32Y and 32M differ from each other, back pressures varying between the ejection heads 32Y and 32M can be generated.

Second Modification of First Exemplary Embodiment

In the aforementioned first exemplary embodiment, the support bodies 62 and 63 generate the relative pressure difference between the inks to be supplied from the supply tanks 44 and 45 to the ejection heads 32Y and 32M due to the hydraulic head difference X between the supply tanks 44 and 45 supported at the different heights. However, the present invention is not limited thereto.

Figure 6:
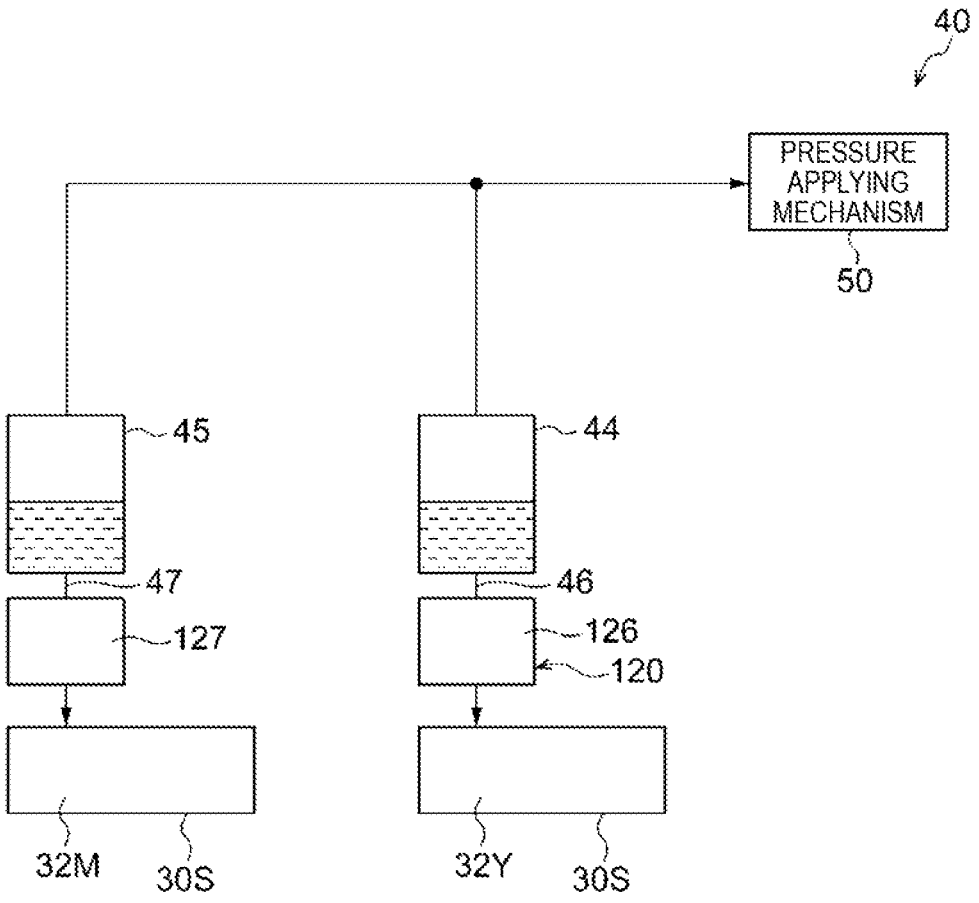
FIG. 6 is a schematic view showing a configuration about ejection heads and a supply mechanism according to a second modification of the first exemplary embodiment.

For example, the pressure difference generating mechanism may be configured to have a resistance applying mechanism 120 that applies flow resistances onto inks in the supply channels 46 and 47, as shown in FIG. 6. The resistance applying mechanism 120 has a resistor 126 and a resistor 127. The resistor 126 applies flow resistance onto the ink in the supply channel 46. The resistor 127 applies flow resistance onto the ink in the supply channel 47.

The flow resistance in the resistor 126 and the flow resistance in the resistor 127 vary from each other. Specifically, for example, the flow resistance in the resistor 126 is made larger than the flow resistance in the resistor 127. Thus, a relative pressure difference can be generated between the inks to be supplied from the supply tanks 44 and 45 to the ejection heads 32Y and 32M.

Thus, in the second modification, the resistance applying mechanism 120 applies the flow resistances onto the inks in the supply channels 46 and 47. Thus, even when the supply tanks 44 and 45 are disposed at vertically the same position (the same height), a pressure difference can be generated.

Figure 7:
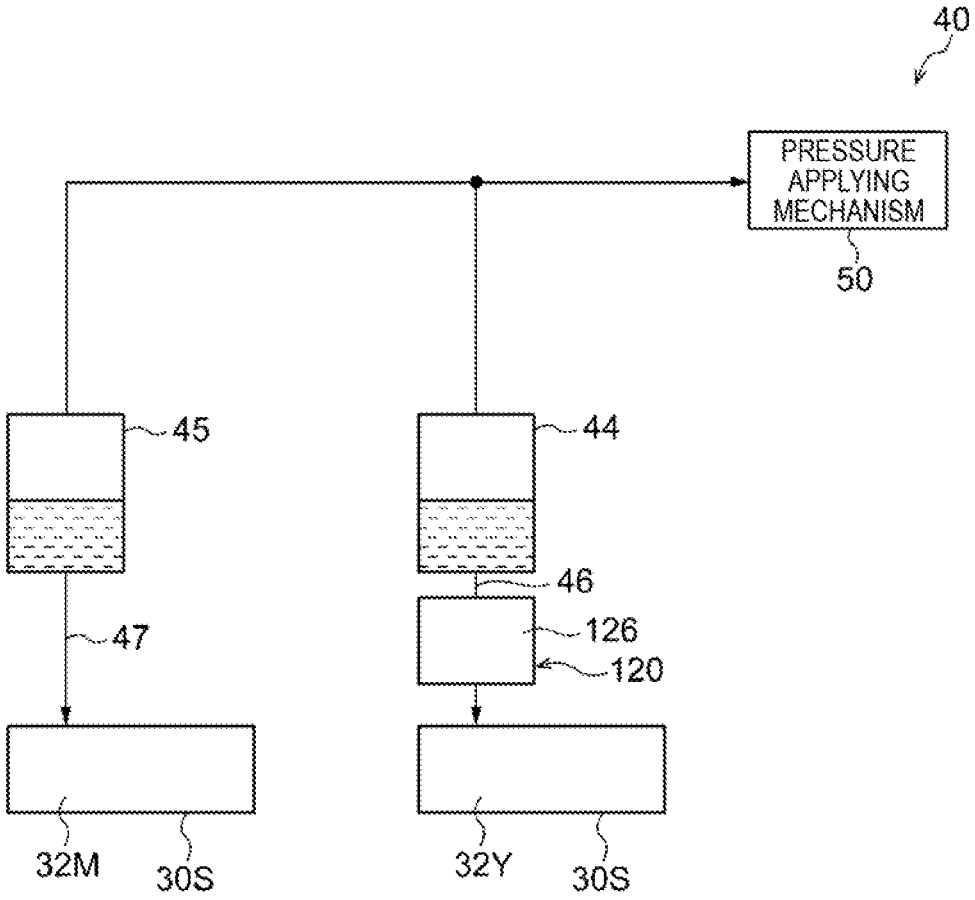
FIG. 7 is a schematic view showing a configuration of another example of the supply mechanism according to the second modification shown in FIG. 6.

Further, as shown in FIG. 7, the resistance applying mechanism 120 may be a mechanism that is provided with the resistor 126 in the supply channel 46 of the supply channels 46 and 47 but not provided with the resistor 127 in the supply channel 47. In this configuration, flow resistance is applied onto the ink in the supply channel 46 but not applied onto the ink in the supply channel 47. Thus, a relative pressure difference can be generated between the inks to be supplied from the supply tanks 44 and 45 to the ejection heads 32Y and 32M.

According to the configuration shown in FIG. 7, the number of resistors is reduced in comparison with a configuration in which a resistor is provided in each of the supply channels 46 and 47.

Second Exemplary Embodiment

Next, an inkjet recording apparatus 200 according to a second exemplary embodiment will be described. The inkjet recording apparatus 200 is provided with a supply mechanism 240 different from the supply mechanism 40 of the inkjet recording apparatus 10. The inkjet recording apparatus 200 has a similar configuration to or the same configuration as the inkjet recording apparatus 10 except that the supply mechanism 240 is provided. Accordingly, the supply mechanism 240 will be mainly described below. Incidentally, description about constituent portions similar to or the same as those of the inkjet recording apparatus 10 will be omitted suitably.

Supply Mechanism 240

The supply mechanism 240 is a mechanism supplying inks to ejection heads 32Y to 32K respectively. Specifically, the supply mechanism 240 is a mechanism that supplies the inks to the ejection heads 32Y to 32K respectively, and collects the inks supplied to the ejection heads 32Y to 32K from the ejection heads 32Y to 32K respectively. Incidentally, the supply mechanism 240 may be a mechanism that supplies the inks from supply tanks 44, 45, . . . to the ejection heads 32Y to 32K respectively, collects the inks from the ejection heads 32Y to 32K into collection tanks 74, 75, . . . respectively, and further returns the collected inks into the supply tanks 44, 95, . . . respectively so that the inks can be circulated.

Figure 8:
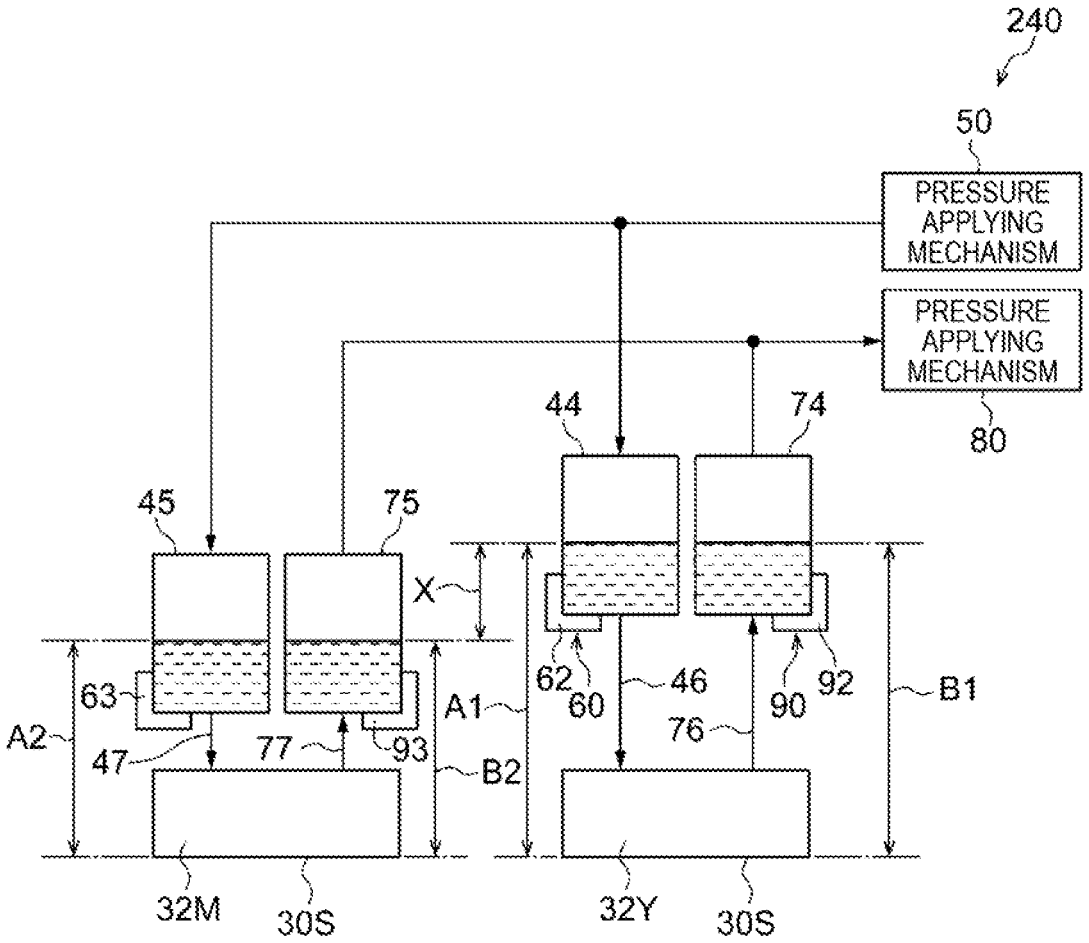
FIG. 8 is a schematic view showing a configuration about ejection heads and a supply mechanism according to a second exemplary embodiment.

Incidentally, constituent portions of the supply mechanism 240 that supply the inks to the ejection heads 32Y and 32M and collect the inks will be described below. FIG. 8 is a schematic view schematically showing a configuration about the ejection heads 32Y and 32M and the supply mechanism 240.

The supply mechanism 240 has the supply tanks 44 and 45, supply channels 46 and 47, a pressure applying mechanism 50, a pressure difference generating mechanism 60, the collection tanks 74 and 75, collection channels 76 and 77, a pressure applying mechanism 80, and a pressure difference generating mechanism 90.

The supply tanks 44 and 45 and the supply channels 46 and 47 are configured in a similar manner to or the same manner as the supply tanks 44 and 45 and the supply channels 46 and 47 in the supply mechanism 40.

The pressure applying mechanism 50 is an example of a common first pressure applying mechanism that applies pressure onto liquids of supply portions. Specifically, the pressure applying mechanism 50 has a function of applying common pressure onto the inks in the supply tanks 44 and 45. More specifically, a pressure transmission route from the pressure applying mechanism 50 is split and connected to the supply tanks 44 and 45. The pressure applying mechanism 50 applies the common pressure onto the inks in the supply tanks 44 and 45 through the transmission route. Specifically, the pressure mentioned herein is positive pressure. More specifically, the pressure applying mechanism 50 is constituted, for example, by a single compressor.

The pressure difference generating mechanism 60 is an example of a first pressure difference generating mechanism that generates a relative pressure difference between ejection portions for the liquids to be supplied from the supply portions to the ejection portions. The pressure difference generating mechanism 60 is configured in a similar manner to or the same manner as the pressure difference generating mechanism 60 in the supply mechanism 40.

The collection tanks 74 and 75 are an example of collection portions that collect the liquids from the ejection portions respectively. Specifically, each of the collection tanks 74 and 75 has a function of collecting ink from a corresponding one of the ejection heads 32Y and 32M. More specifically, the collection tank 74, 75 functions as a reservoir portion that reserves the ink collected from the ejection head 32Y, 32M.

The collection channels 76 and 77 are an example of collection routes from the ejection portions to the collection portions. Specifically, the collection channels 76 and 77 are routes (passageways) through which the inks are collected from the ejection heads 32Y and 32M into the collection tanks 74 and 75 respectively. More specifically, each of the collection channels 76 and 77 has one end portion (upstream end portion) connected to the ejection head 32Y, 32M, and the other end portion (downstream end portion) connected to the collection tank 74, 75.

The pressure applying mechanism 80 is an example of a common second pressure applying mechanism that applies pressure onto the liquids at the collection portions. Specifically, the pressure applying mechanism 80 has a function of applying common pressure onto the inks in the collection tanks 74 and 75. More specifically, a pressure transmission route from the pressure applying mechanism 80 is split and connected to the collection tanks 74 and 75. The pressure applying mechanism 80 applies the common pressure onto the inks in the collection tanks 74 and 75 through the transmission route. Specifically, the pressure mentioned herein is negative pressure. More specifically, the pressure applying mechanism 80 is constituted, for example, by a single vacuum pump.

The pressure difference generating mechanism 90 is an example of a second pressure difference generating mechanism that generates the relative pressure difference between the ejection portions for the liquids to be collected from the ejection portions into the collection portions. Specifically, the pressure difference generating mechanism 90 generates the relative pressure difference between the ejection heads 32Y and 32M for the inks to be collected from the ejection heads 32Y and 32M into the collection tanks 74 and 75.

More specifically, the pressure difference generating mechanism 90 is constituted by support bodies 92 and 93 that support the collection tanks 74 and 75 at different heights (i.e. vertically different positions) respectively. The support bodies 92 and 93 generate a relative pressure difference between the inks to be collected from the ejection heads 32Y and 32M into the collection tanks 74 and 75 due to a hydraulic head difference X between the collection tanks 74 and 75 supported at the different heights. That is, the relative pressure difference is generated between the inks to be supplied from the collection tanks 74 and 75 to the ejection heads 32Y and 32M due to the hydraulic head difference X between a liquid surface of the collection tank 74 and a liquid surface of the collection tank 75.

In other words, the support bodies 92 and 93 support the collection tanks 74 and 75 so that a hydraulic head difference (see B1) between the liquid surface of the collection tank 74 and a nozzle surface 30S of the ejection head 32Y and a hydraulic head difference (see B2) between the liquid surface of the collection tank 75 and a nozzle surface 30S of the ejection head 32M vary from each other. Thus, the relative pressure difference can be generated between the inks to be collected from the ejection heads 32Y and 32M into the collection tanks 74 and 75.

In the present exemplary embodiment, the collection tank 74 is disposed at a position higher than the collection tank 75. The liquid surface of the collection tank 74 is disposed at a position higher than the liquid surface of the collection tank 75. Thus, the hydraulic head difference B1 is larger than the hydraulic head difference B2. In addition, the hydraulic head difference B1 is made equal to a hydraulic head difference A1 between a liquid surface of the supply tank 44 and the nozzle surface 30S of the ejection head 32Y. In other words, the liquid surface of the supply tank 44 and the liquid surface of the collection tank 74 are disposed at the same height. Further, the hydraulic head difference B2 is made equal to a hydraulic head difference A2 between a liquid surface of the supply tank 45 and the nozzle surface 30S of the ejection head 32M. In other words, the liquid surface of the supply tank 45 and the liquid surface of the collection tank 75 are disposed at the same height.

Incidentally, in the present exemplary embodiment, both the collection tanks 74 and 75 are disposed at positions higher than the nozzle surfaces 30S of the ejection heads 32Y and 32M. That is, when only the pressure difference generating mechanism 90 is viewed, positive pressure is applied onto the inks to be supplied from the collection tanks 74 and 75 to the ejection heads 32Y and 32M.

Effect of Second Exemplary Embodiment

According to the supply mechanism 240 of the inkjet recording apparatus 200, the pressure applying mechanism 50 applies common pressure onto the inks in the supply tanks 44 and 45, and the pressure difference generating mechanism 60 generates a relative pressure difference between the inks to be supplied from the supply tanks 44 and 45 to the ejection heads 32Y and 32M. Therefore, back pressures varying between the ejection heads 32Y and 32M can be generated while the number of pressure applying mechanisms for supplying inks is reduced, in comparison with a configuration shown in FIG. 9 (third comparative example) in which pressure applying mechanisms 50 and 51 apply pressures onto inks in supply tanks 44 and 45 respectively to thereby generate a relative pressure difference between ejection heads 32Y and 32M for the inks.

Further, according to the supply mechanism 240 of the inkjet recording apparatus 200, the pressure applying mechanism 80 applies common pressure onto the inks in the collection tanks 74 and 75. Further, in the pressure difference generating mechanism 90, the support bodies 92 and 93 generate the relative pressure difference between the inks to be collected from the ejection heads 32Y and 32M into the collection tanks 74 and 75 due to the hydraulic head difference X between the collection tanks 74 and 75 supported at the different heights.

Figure 9:
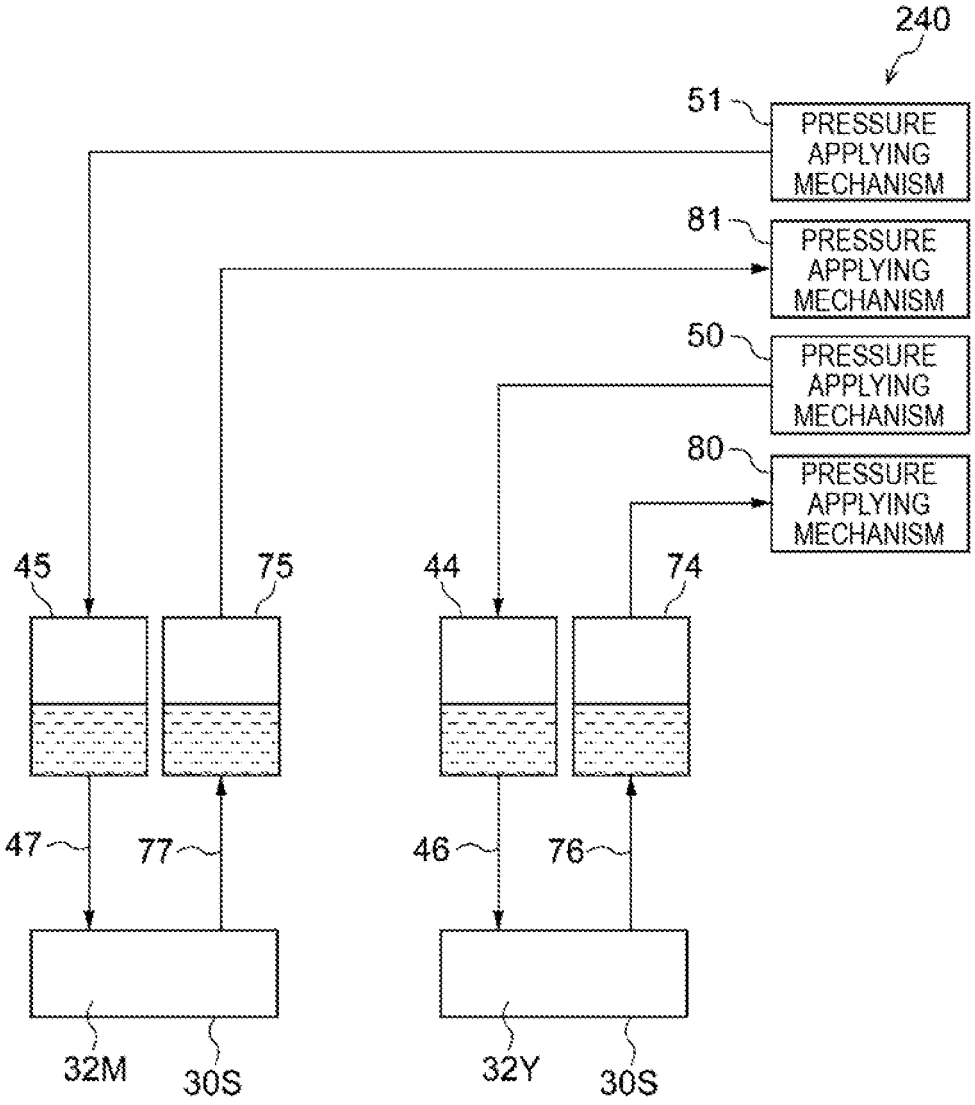
FIG. 9 is a schematic view showing a configuration about ejection heads and a supply mechanism according to a third comparative example.

Here, in the configuration (third comparative example) in which pressure applying mechanisms 80 and 81 apply pressures onto inks in collection tanks 74 and 75 respectively to generate a relative pressure difference between the ejection heads 32Y and 32M for the inks, as shown in FIG. 9, the pressure applying mechanisms as many as the collection tanks are required. That is, a plurality of (specifically two) pressure applying mechanisms for collection are required in the third comparative example.

On the other hand, in the present exemplary embodiment, the pressure applying mechanism 80 applies the common pressure onto the inks in the collection tanks 74 and 75, and the pressure difference generating mechanism 90 generates a relative pressure difference between the inks to be supplied from the collection tanks 74 and 75 to the ejection heads 32Y and 32M, as described above. Therefore, back pressures varying between the ejection heads 32Y and 32M can be generated while the number of pressure applying mechanisms for collecting inks is reduced, in comparison with the third comparative example.

Figure 10:
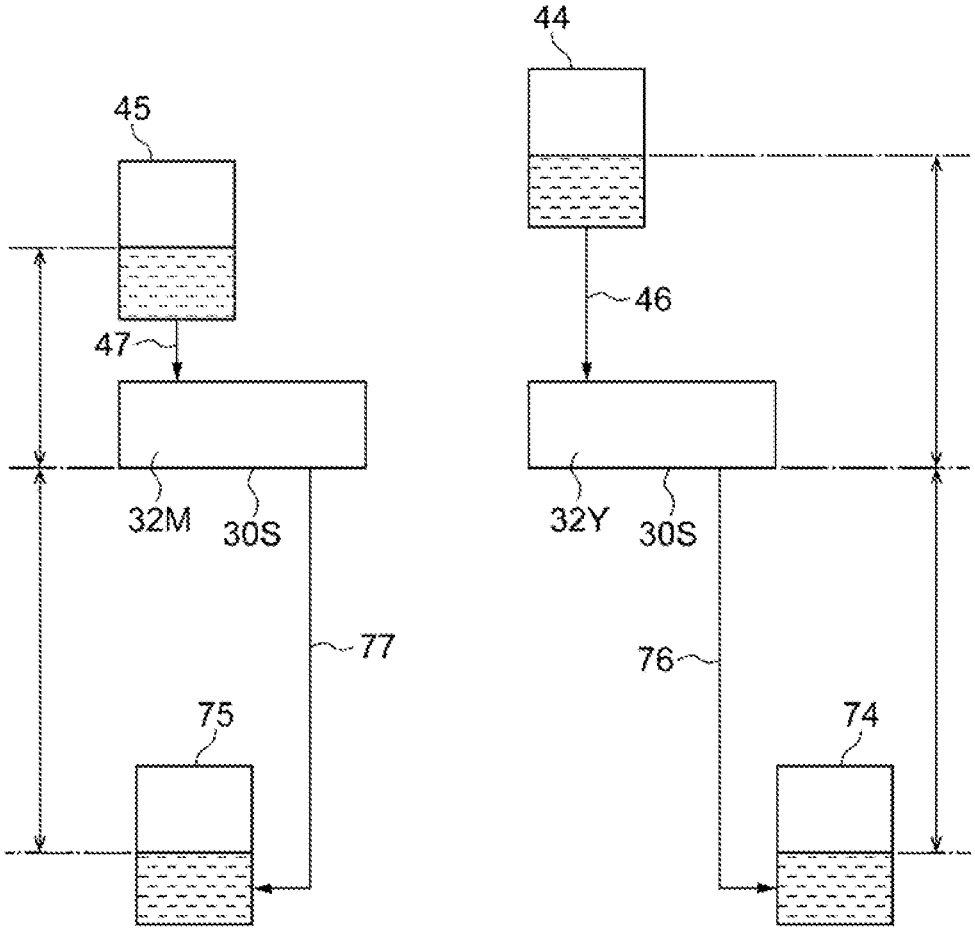
FIG. 10 is a schematic view showing a configuration about ejection heads and a supply mechanism according to a fourth comparative example.

In addition, in a configuration (fourth comparative example) in which back pressures are generated for inks in ejection heads 32Y and 32M due to only hydraulic head differences between liquid surfaces of supply tanks 44 and 45 and nozzle surfaces 30S of the ejection heads 32Y and 32M and hydraulic head differences between liquid surfaces of collection tanks 74 and 75 and the nozzle surfaces 30S of the ejection heads 32Y and 32M, as shown in FIG. 10, heights of the liquid surfaces of the collection tanks 74 and 75 have to be disposed to be lower than heights of the nozzle surfaces 30S of the ejection heads 32Y and 32M. Accordingly, there is a restriction on positions where the collection tanks 74 and 75 can be disposed in the fourth comparative example.

On the other hand, in the present exemplary embodiment, the pressure applying mechanism 80 applies the common pressure onto the inks in the collection tanks 74 and 75, and the pressure difference generating mechanism 90 generates the relative pressure difference between the inks to be supplied from the collection tanks 74 and 75 to the ejection heads 32Y and 32M, as described above. Therefore, the heights of the liquid surfaces of the collection tanks 74 and 75 may be disposed to be higher than heights of the nozzle surfaces 30S of the ejection heads 32Y and 32M. Thus, the degree of freedom for positions where the collection tanks 74 and 75 can be disposed is higher than that in the fourth comparative example.

In addition, in the present exemplary embodiment, the pressure difference generating mechanism 90 generates the relative pressure difference between the inks to be collected from the ejection heads 32Y and 32M into the collection tanks 74 and 75 due to the hydraulic head difference X between the collection tanks 74 and 75 supported at the different heights, as described above. Therefore, even when flow resistances applied onto the inks in the collection channels 76 and 77 are made equal to each other, a relative pressure difference can be generated between the inks to be supplied from the collection tanks 74 and 75 to the ejection heads 32Y and 32M.

First Modification of Second Exemplary Embodiment

Figure 11:
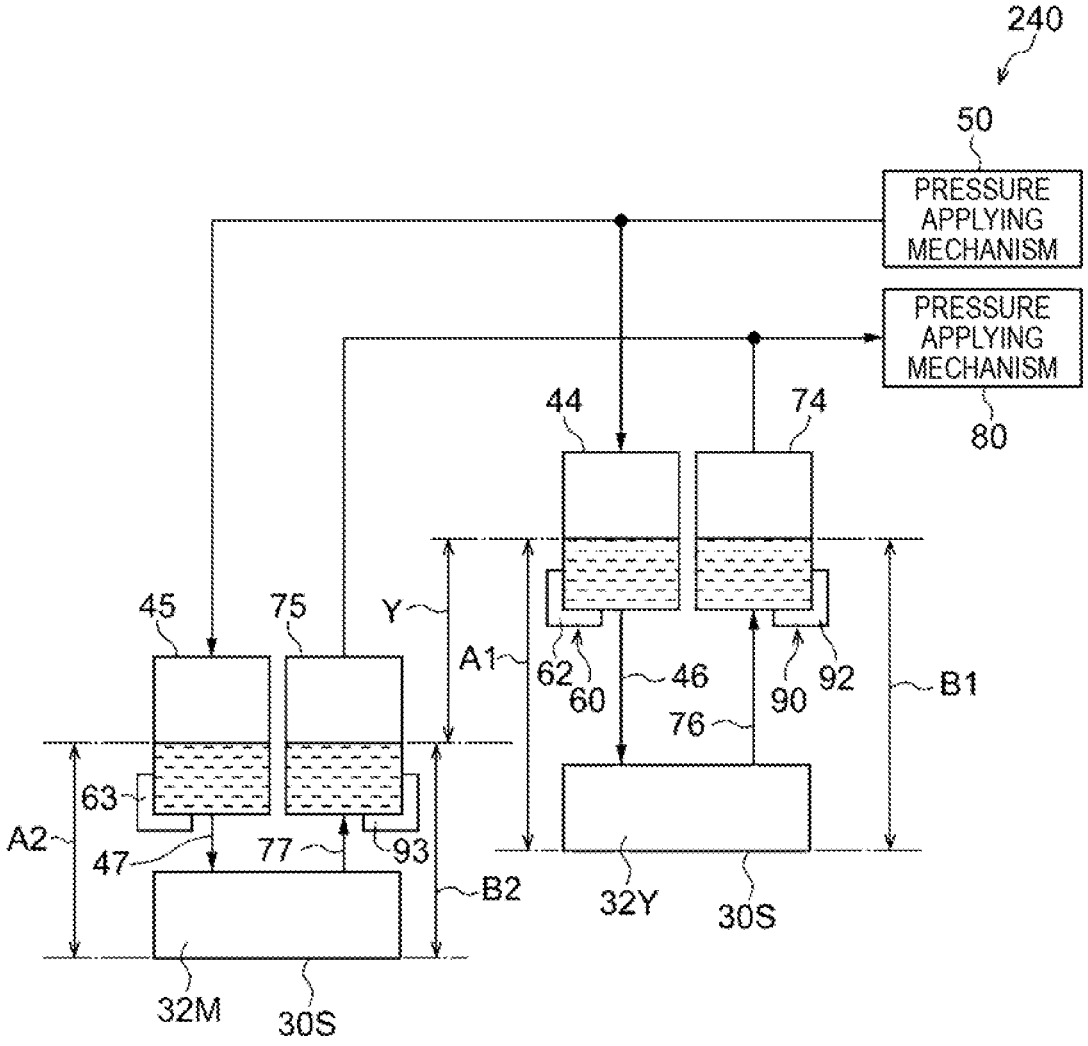
FIG. 11 is a schematic view showing a configuration about ejection heads and a supply mechanism according to a first modification of the second exemplary embodiment.

In the aforementioned exemplary embodiment, the ejection heads 32Y and 32M are disposed so that the nozzle surfaces 30S of the ejection heads 32Y and 32M are positioned at the same height. However, the present invention is not limited thereto. For example, as shown in FIG. 11, the ejection heads 32Y and 32M may be disposed so that the nozzle surfaces 30S of the ejection heads 32Y and 32M are positioned at vertically different positions (different heights). Specifically, for example, the ejection head 32Y is disposed at a position higher than the ejection head 32M.

Also in the configuration, the support bodies 62 and 63 generate a relative pressure difference between the inks to be supplied from the supply tanks 44 and 45 to the ejection heads 32Y and 32M due to a hydraulic head difference Y between the supply tanks 44 and 45 supported at different heights.

In addition, the support bodies 92 and 93 generate the relative pressure difference between the inks to be collected from the ejection heads 32Y and 32M into the collection tanks 74 and 75 due to the hydraulic head difference Y between the collection tanks 74 and 75 supported at the different heights.

Incidentally, the hydraulic head difference Y between the liquid surface of the supply tank 44 and the liquid surface of the supply tank 45 is larger than the hydraulic head difference X (see FIG. 8) in the aforementioned second exemplary embodiment.

Also in the configuration of the present first modification, the pressure applying mechanism 50 applies the common pressure onto the inks in the supply tanks 44 and 45, and the pressure difference generating mechanism 60 generates the relative pressure difference between the inks to be supplied from the supply tanks 44 and 45 to the ejection heads 32Y and 32M, as described above. Further, the pressure applying mechanism 80 applies the common pressure onto the inks in the collection tanks 74 and 75, and the pressure difference generating mechanism 90 generates the relative pressure difference between the inks to be supplied from the collection tanks 74 and 75 to the ejection heads 32Y and 32M. Therefore, even when vertically relative positions of the ejection heads 32Y and 32M differ from each other, back pressures varying between the ejection heads 32Y and 32M can be generated.

Second Modification of Second Exemplary Embodiment

In the aforementioned second exemplary embodiment, the liquid surface of the supply tank 44 supplying the ink to the ejection head 32Y (an example of one ejection portion) and the liquid surface of the collection tank 74 collecting the ink from the ejection head 32Y are disposed at the same height. However, the present invention is not limited thereto.

Figure 12:
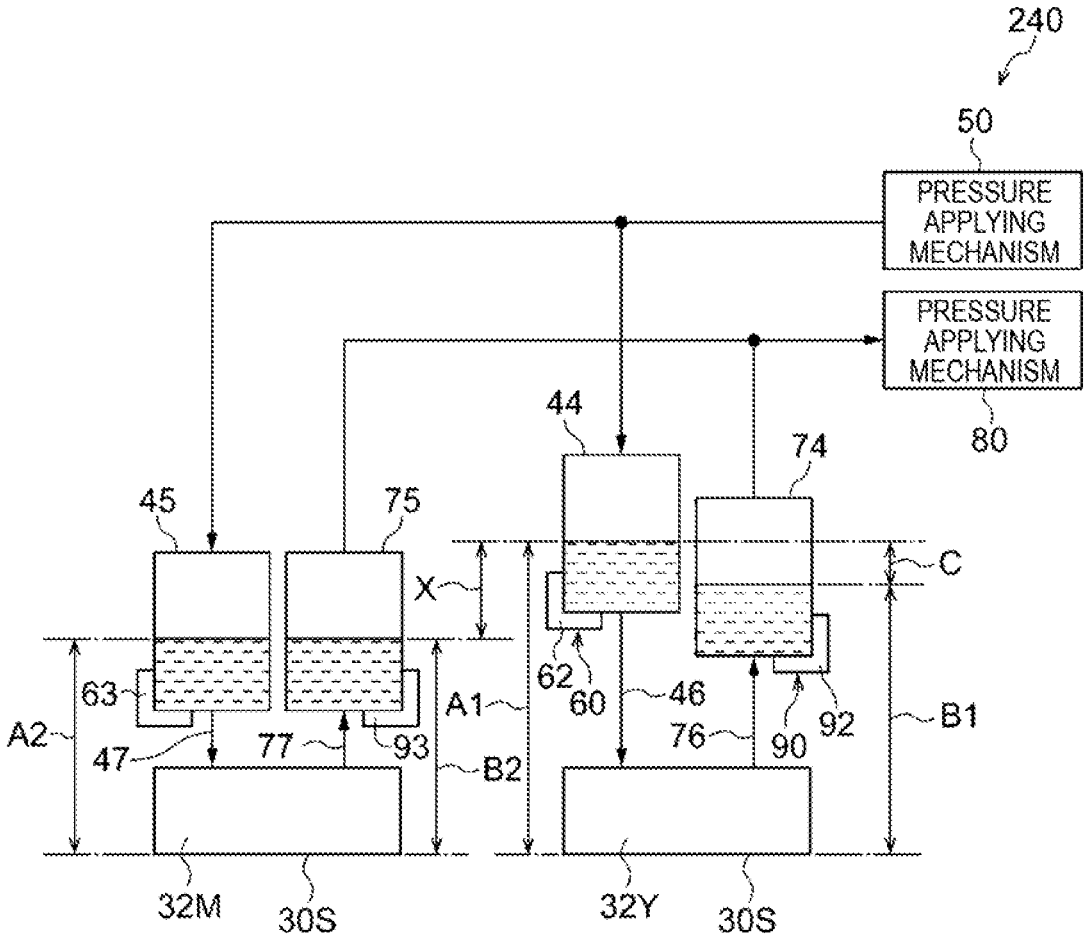
FIG. 12 is a schematic view showing a configuration about ejection heads and a supply mechanism according to a second modification of the second exemplary embodiment.

For example, as shown in FIG. 12, the supply tank 44 and the collection tank 74 may be disposed at different heights to thereby generate a hydraulic head difference (see C) between the supply tank 44 and the collection tank 74.

Figure 13:
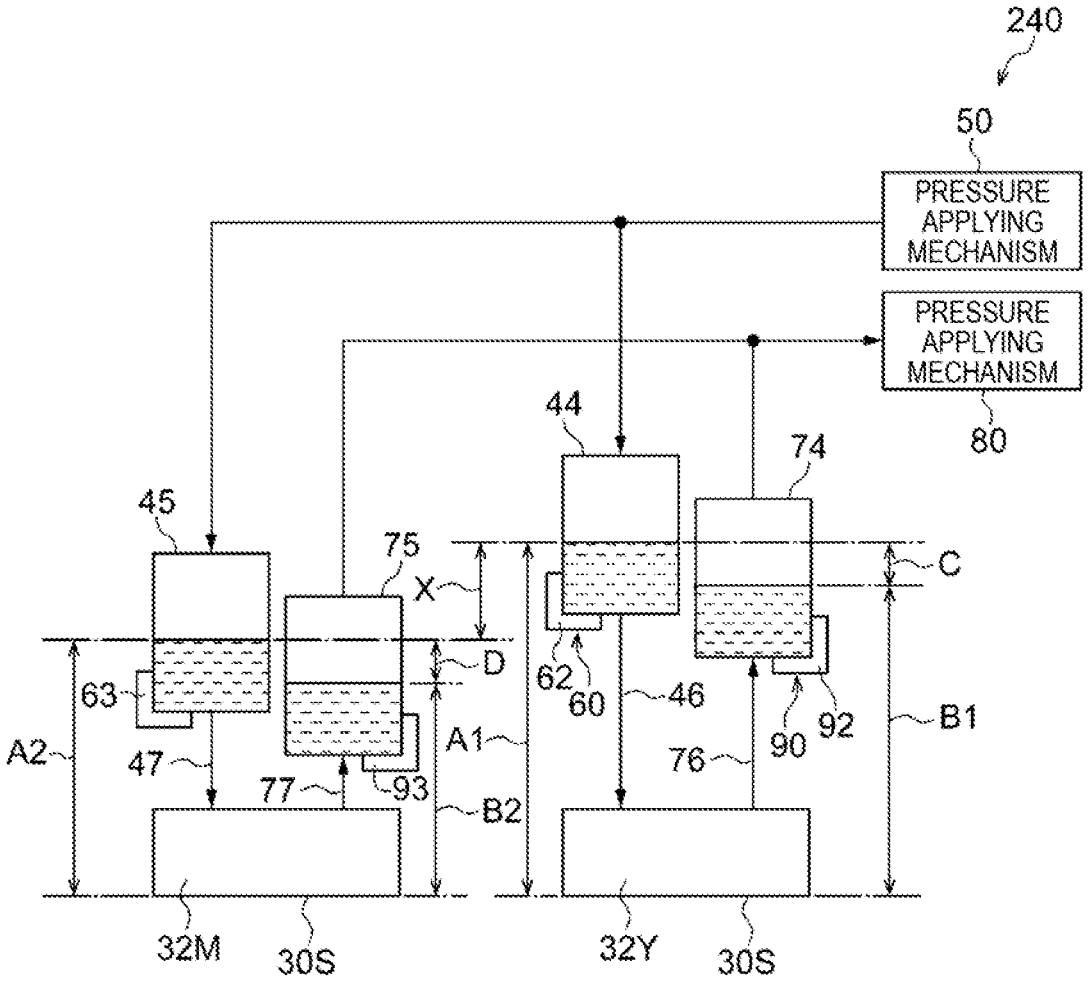
FIG. 13 is a schematic view showing a configuration of another example of the supply mechanism according to the second modification shown in FIG. 12.

Further, as shown in FIG. 13, the supply tank 45 and the collection tank 75 may be disposed at different heights to thereby generate a hydraulic head difference (see D) between the supply tank 45 and the collection tank 75.

According to the configuration of the second modification, the differential pressure between the supply tank 44 and the collection tank 74 can be changed between the ejection heads 32Y and 32M while the number of pressure applying mechanisms is reduced, in comparison with the configuration (third comparative example) in which the pressure applying mechanisms 50 and 51 apply pressures onto the inks in the supply tanks 44 and 45 respectively and the pressure applying mechanisms 80 and 81 apply pressures onto the inks in the collection tanks 74 and 75 respectively so that differential pressure between the supply tank 44 and the collection tank 74 can be changed between the ejection heads 32Y and 32M.

Third Modification of Second Exemplary Embodiment

In the aforementioned second exemplary embodiment, the support bodies 62 and 63 generate the relative pressure difference between the inks to be supplied from the supply tanks 44 and 45 to the ejection heads 32Y and 32M due to the hydraulic head difference X between the supply tanks 44 and 45 supported at the different heights. However, the present invention is not limited thereto.

Figure 14:
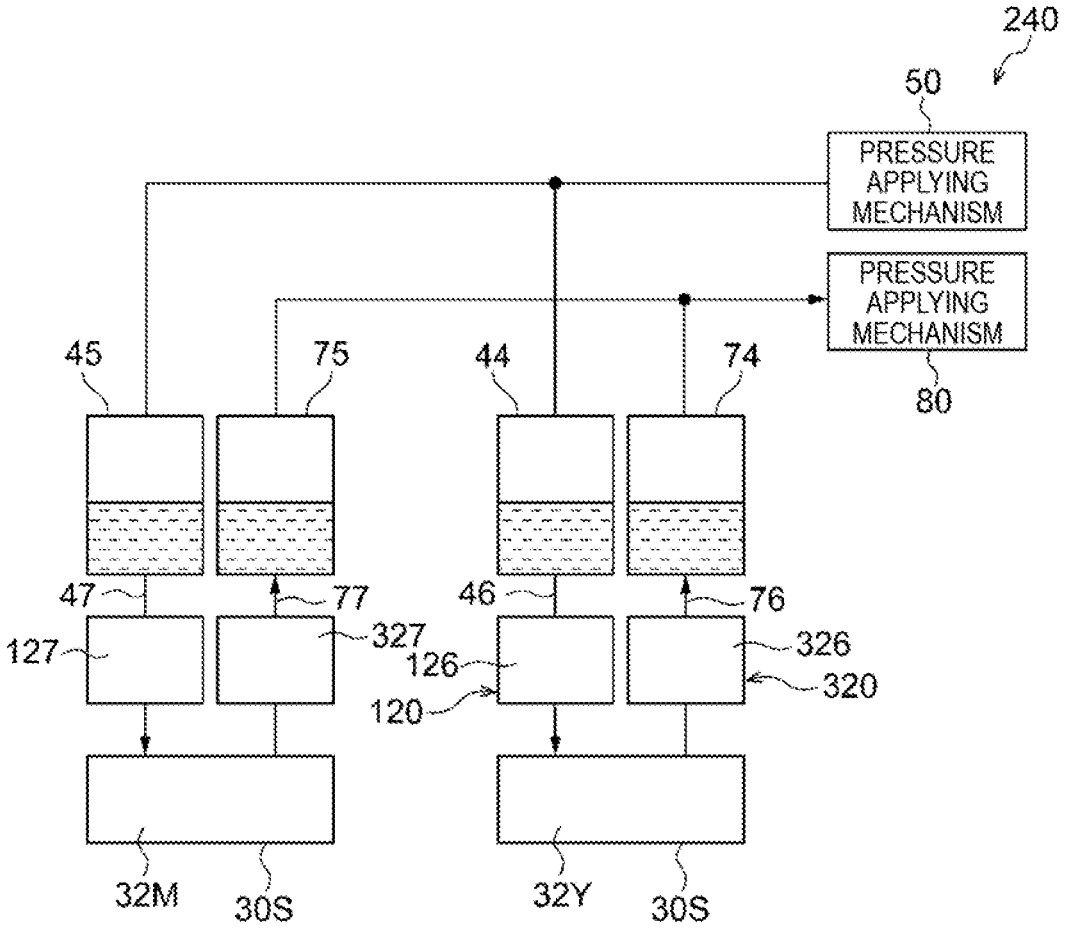
FIG. 14 is a schematic view showing a configuration about ejection heads and a supply mechanism according to a third modification of the second exemplary embodiment.

For example, the pressure difference generating mechanism may be configured to have a resistance applying mechanism 120 that applies flow resistances onto inks in supply channels 46 and 47, as shown in FIG. 14. The resistance applying mechanism 120 has a resistor 126 and a resistor 127. The resistor 126 applies flow resistance onto the ink in the supply channel 46. The resistor 127 applies flow resistance onto the ink in the supply channel 47.

The flow resistance in the resistor 126 and the flow resistance in the resistor 127 vary from each other. Specifically, the flow resistance in the resistor 126 is made larger than the flow resistance in the resistor 127. Thus, a relative pressure difference can be generated between the inks to be supplied from the supply tanks 44 and 45 to the ejection heads 32Y and 32M.

Thus, in the third modification, the resistance applying mechanism 120 applies the flow resistances onto the inks in the supply channels 46 and 47. Accordingly, even when the supply tanks 44 and 45 are disposed at vertically the same position (the same height), a pressure difference can be generated.

In addition, in the second exemplary embodiment, the support bodies 92 and 93 generate the relative pressure difference between the inks to be collected from the ejection heads 32Y and 32M into the collection tanks 74 and 75 due to the hydraulic head difference X between the collection tanks 74 and 75 supported at the different heights. However, the present invention is not limited thereto.

For example, the pressure difference generating mechanism may be configured to have a resistance applying mechanism 320 that applies flow resistances onto inks in collection channels 76 and 77, as shown in FIG. 14. The resistance applying mechanism 320 has a resistor 326 and a resistor 327. The resistor 326 applies flow resistance onto the ink in the collection channel 76. The resistor 327 applies flow resistance onto the ink in the collection channel 77.

The flow resistance in the resistor 326 and the flow resistance in the resistor 327 vary from each other. Specifically, for example, the flow resistance in the resistor 326 is made larger than the flow resistance in the resistor 327. Thus, a relative pressure difference can be generated between the inks to be collected from the ejection heads 32Y and 32M into the collection tanks 74 and 75.

Thus, in the third modification, the resistance applying mechanism 320 applies the flow resistances onto the inks in the collection channels 76 and 77. Accordingly, even when the collection tanks 74 and 75 are disposed at the same height, a pressure difference can be generated.

Figure 15:
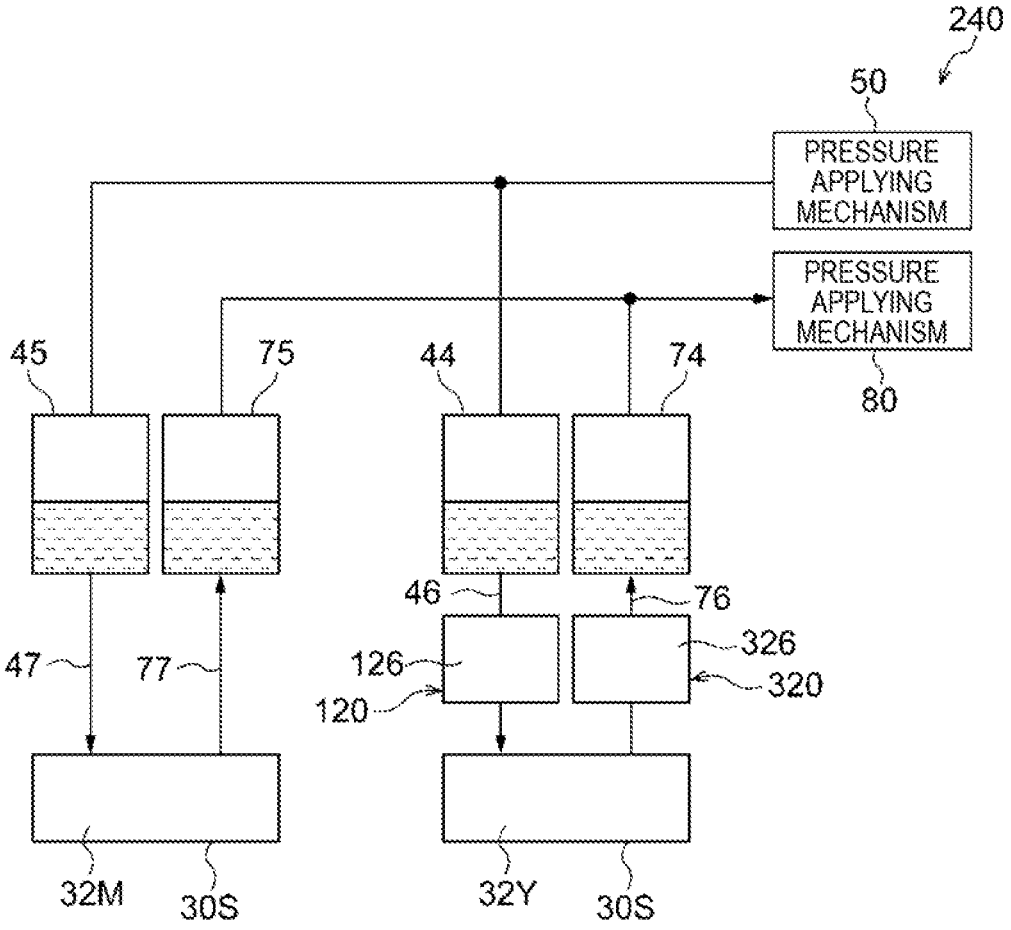
FIG. 15 is a schematic view showing a configuration of another example of the supply mechanism according to the third modification shown in FIG. 14.

Further, as shown in FIG. 15, the resistance applying mechanism 120 may be a mechanism that is provided with the resistor 126 in the supply channel 46 of the supply channels 46 and 47 but not provided with the resistor 127 in the supply channel 47. In this configuration, flow resistance is applied onto the ink in the supply channel 46 but not applied onto the ink in the supply channel 47. Thus, a relative pressure difference can be generated between the inks to be supplied from the supply tanks 44 and 45 to the ejection heads 32Y and 32M.

Further, as shown in FIG. 15, the resistance applying mechanism 320 may be a mechanism that is provided with the resistor 326 in the collection channel 76 of the collection channels 76 and 77 but not provided with the resistor 327 in the collection channel 77. In this configuration, flow resistance is applied onto the ink in the collection channel 76 but not applied onto the ink in the collection channel 77. Thus, a relative pressure difference can be generated between the inks to be collected from the ejection heads 32Y and 32M into the collection tanks 74 and 75.

According to the configuration shown in FIG. 15, the number of resistors can be reduced in comparison with a configuration in which a resistor is provided in each of the supply channels 46 and 47 and the collection channels 76 and 77.

Other Modifications

In the present exemplary embodiment, the ejection mechanism 12 has been described as an example of an ejection device that ejects inks as liquids from ejection portions onto a recording medium fed by a feed portion. However, the present invention is not limited thereto. For example, the inkjet recording apparatus 10 may be grasped as an example of an ejection device that ejects inks as liquids from ejection portions onto a recording medium fed by a feed portion. Incidentally, a film forming device that ejects a liquid to form a film, a 3D printer, etc. may be used as the ejection device.

The present invention is not limited to the aforementioned exemplary embodiments. The present invention can be variously modified, changed or improved without departing from the gist of the present invention. For example, ones of the aforementioned modifications may be combined and configured suitably.

What is claimed is:

1. An ejection device comprising:
ejection portions that eject liquids;
supply portions that supply the liquids to the ejection portions respectively;
a common first pressure applying mechanism that applies pressure onto the liquids at the supply portions;
a first pressure difference generating mechanism that generates a relative pressure difference between the ejection portions for the liquids to be supplied from the supply portions to the ejection portions;
collection portions that collect the liquids from the ejection portions respectively;
a common second pressure applying mechanism that applies pressure onto the liquids at the collection portions; and
a second pressure difference generating mechanism that generates a relative pressure difference between the ejection portions for the liquids to be collected from the ejection portions into the collection portions.

2. The ejection device according to claim 1, wherein:
the first pressure difference generating mechanism has a resistance applying mechanism that applies flow resistances onto the liquids in supply routes from the supply portions to the ejection portions.

3. The ejection device according to claim 2, wherein:
the resistance applying mechanism is a mechanism that is provided with a resistor applying flow resistance in one of the supply routes but not provided with the resistor in other of the supply routes.

4. The ejection device according to claim 3, wherein:
vertically relative positions of the ejection portions vary from each other.

5. The ejection device according to claim 2, wherein:
vertically relative positions of the ejection portions vary from each other.

6. The ejection device according to claim 1, wherein:
the first pressure difference generating mechanism generates the pressure difference due to a hydraulic head difference between the supply portions.

7. The ejection device according to claim 6, wherein:
vertically relative positions of the ejection portions vary from each other.

8. The ejection device according to claim 1, wherein:
the second pressure difference generating mechanism has a resistance applying mechanism that applies flow resistances onto the liquids in collection routes from the ejection portions to the collection portions.

9. The ejection device according to claim 8, wherein:
the resistance applying mechanism is a mechanism that is provided with a resistor applying flow resistance in one of the collection routes but not provided with the resistor in other of the collection routes.

10. The ejection device according to claim 1, wherein:
the second pressure difference generating mechanism generates the pressure difference based on a hydraulic head difference between the collection portions.

11. The ejection device according to claim 10, wherein:
a hydraulic head difference is generated between one of the supply portions, that supplies the liquid to one of the ejection portions, and one of the collection portions, that collects the liquid from the one of the ejection portions.

12. The ejection device according to claim 1, wherein:
vertically relative positions of the ejection portions vary from each other.

13. An image forming apparatus comprising:
a feed portion that feeds a recording medium; and
the ejection device according to claim 1 that ejects liquids from ejection portions onto the recording medium fed by the feed portion.

14. An ejection device comprising:
ejection portions that eject liquids;
supply portions that supply the liquids to the ejection portions respectively;
a common first pressure generating mechanism that generates reference pressure as a reference for the liquids to be supplied from the supply portions to the ejection portions respectively;
a first change mechanism that changes the reference pressure generated for the liquid to be supplied from one of the supply portions to one of the ejection portions, to different pressure;
collection portions that collect the liquids from the ejection portions respectively;
a common second pressure generating mechanism that generates reference pressure as a reference for the liquids to be collected from the ejection portions into the collection portions; and
a second change mechanism that changes the reference pressure generated for the liquid to be collected from one of the ejection portions into one of the collection portions, to different pressure.

* * * * *